US006141930A

United States Patent [19]

Allwein et al.

[11] Patent Number: 6,141,930

[45] **Date of Patent: *Nov. 7, 2000**

[54] METHOD OF AND ARTICLE FOR INSULATING STANDARD AND NONSTANDARD CAVITIES AND AN INSULATED STRUCTURE

[75] Inventors: Robert John Allwein; Larry Joel Weinstein; William Harrison Olbert, all of Littleton, Colo.

[73] Assignee: Johns Manville International, Inc., Denver, Colo.

[ * ] Notice: Under 35 U.S.C. 154(b), the term of this patent shall be extended for 320 days.

[21] Appl. No.: 08/724,340

[22] Filed: Oct. 1, 1996

Related U.S. Application Data

[63] Continuation-in-part of application No. 08/632,824, Apr. 16, 1996, abandoned.

[51] Int. Cl.[7] ..... E04B 1/74

[52] U.S. Cl. ..... 52/404.1; 52/406.1; 52/742.12; 52/404.3

[58] Field of Search ..... 52/404.1, 404.2, 52/404.3, 406.1, 406.2, 406.3, 742.12, 746.1

[56] References Cited

U.S. PATENT DOCUMENTS

| | | | |
|---|---|---|---|
| 1,901,999 | 3/1933 | Upson | 52/406.1 |
| 2,271,575 | 2/1942 | Waterman . | |
| 2,335,220 | 11/1943 | Edwards . | |
| 2,335,968 | 12/1943 | Sawtell . | |
| 2,739,677 | 3/1956 | Greulich | 52/404.4 X |
| 3,003,902 | 10/1961 | McDuff | 52/406.2 X |
| 3,048,513 | 8/1962 | Hughes | 52/404.3 X |
| 3,231,944 | 2/1966 | Bennett | 52/406.1 |
| 3,729,879 | 5/1973 | Franklin | 52/406.1 X |
| 4,129,972 | 12/1978 | Sherman et al. | 52/404.3 X |
| 4,155,208 | 5/1979 | Shanabarger . | |
| 4,516,374 | 5/1985 | Finney . | |
| 4,646,499 | 3/1987 | Wilson | 52/406.1 X |
| 4,856,247 | 8/1989 | Georgino . | |
| 4,866,905 | 9/1989 | Bihy . | |
| 5,085,022 | 2/1992 | Paliwods . | |
| 5,099,629 | 3/1992 | Gay | 52/406.2 |
| 5,277,955 | 1/1994 | Schelhorn . | |
| 5,331,787 | 7/1994 | Kaarst . | |
| 5,421,133 | 6/1995 | Berdan, II et al. | 52/406.1 X |
| 5,545,453 | 8/1996 | Grant | 52/406.1 X |

FOREIGN PATENT DOCUMENTS

| | | | |
|---|---|---|---|
| 3530052 | 3/1987 | Germany | 52/406.2 |
| 644919 | 8/1984 | Switzerland | 52/406.2 |

*Primary Examiner*—Carl D. Friedman
*Assistant Examiner*—Winnie S. Yip
*Attorney, Agent, or Firm*—John D. Lister

[57] ABSTRACT

An insulation assembly for insulating elongated wall, ceiling, floor and roof cavities having standard widths and nonstandard widths less or greater than standard widths for such cavities, includes a series of elongated insulation modules separably joined together and having widths less than the standard cavity width for the cavities to be insulated. Preferably, each of the modules are compressible and resilient in the direction of their widths and include a fibrous insulation encapsulated within a plastic film envelope. An insulation panel, having a width approximating the width of the cavity to be insulated, is formed by separating a selected number of one or more modules from the series of modules. The insulation panel is then inserted into the cavity and secured in place to insulate the cavity. In the insulation of many cavities, the insulation panel can be held in place within the cavity by first compressing the insulation panel in the direction of its width before inserting the insulation panel into the cavity. The insulation panel then expands within the cavity to form a friction fit with framing members defining the width of the cavity.

29 Claims, 3 Drawing Sheets

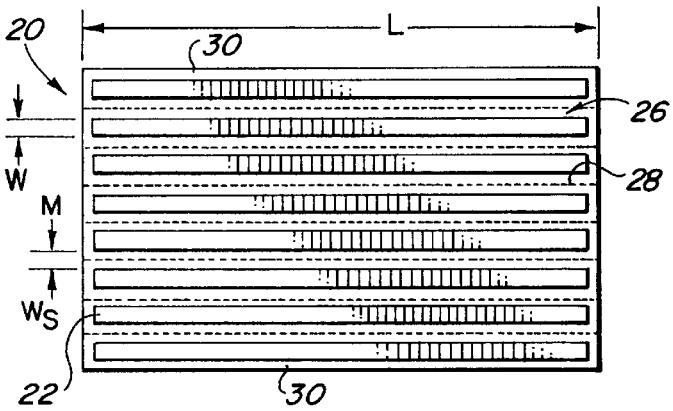
FIG. 1
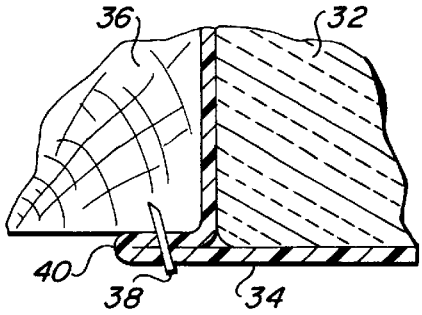
FIG. 5
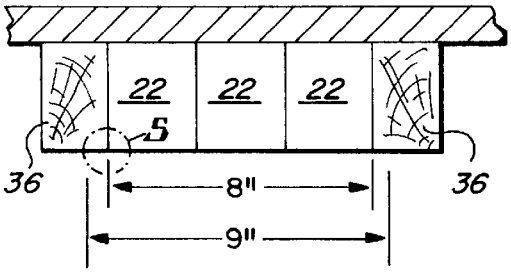
FIG. 4
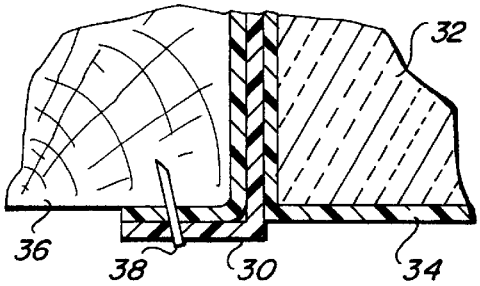
FIG. 6
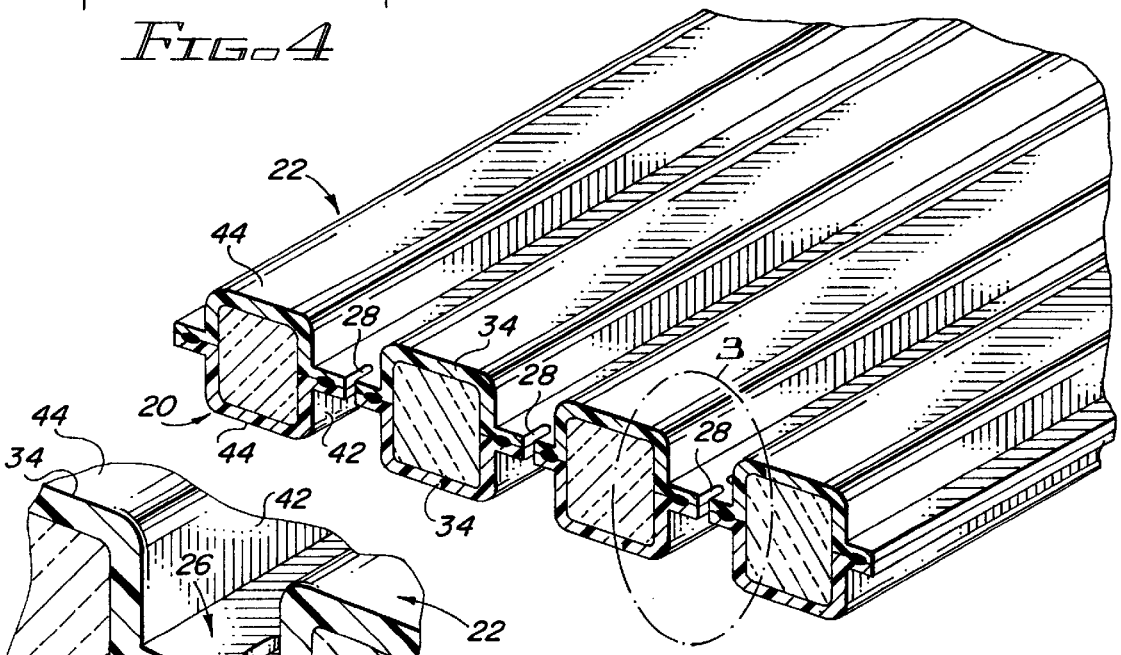
FIG. 2
FIG. 3

METHOD OF AND ARTICLE FOR INSULATING STANDARD AND NONSTANDARD CAVITIES AND AN INSULATED STRUCTURE

This application is a continuation in part of copending U.S. application Ser. No. 08/632,824 filed Apr. 16, 1996 now abandoned.

BACKGROUND OF THE INVENTION

The present invention relates to a method of and an article for insulating both standard and nonstandard wall, ceiling, floor and roof cavities of buildings and similar structures with insulating materials, such as encapsulated fibrous insulations and foam insulations, wherein the widths of the standard cavities are defined by framing members spaced-apart a standard distance for such cavities and the widths of the nonstandard cavities are defined by framing members spaced-apart various distances less or greater than the standard spacing for such framing members and the insulated structures formed thereby.

Building structures, such as homes, industrial buildings, office buildings, mobile homes, prefabricated buildings and similar structures typically include walls (both interior and exterior), ceilings, floors and roofs which are insulated for both thermal and acoustical purposes, especially the exterior walls and the roofs of such structures. The walls, ceilings, floors and roofs of these structures include framing members, e.g. studs, rafters, joists, beams and similar support members, which are normally spaced-apart standard distances, and to which sheathing, paneling, lathing or similar construction materials are secured to form the walls, ceilings, floors and roofs. While the contractor seeks to maintain the spacing of such framing members in these structures at these standard distances for ease of construction and insulation of the elongated cavities formed in these walls, ceilings, floors, and roofs, frequently the walls, ceilings, floors and/or roofs of these structures include elongated cavities defined, at least in part, by adjacent framing members which are spaced apart a nonstandard distance less than the standard spacing between framing members. It is estimated that, in home construction, it is common for 25% or more of the framing members in the exterior walls of these structures to be spaced apart at nonstandard distances less than the standard spacing for such framing members.

When insulating these elongated cavities of various nonstandard widths, less than a standard width, it has been the practice to take an insulation batt preformed to fit the standard cavity width and reduce the width of the insulation batt by cutting off and removing a strip of insulation material from one or both longitudinal edges of the insulation batt. U.S. Pat. No. 5,331,787; issued Jul. 26, 1994; to Kaarst; illustrates this approach. In the invention of this patent, the insulation batts or panels have widths at least equal to a predetermined maximum distance between adjacent support members defining the cavities that the batts or panels are to insulate. The batts or panels are provided with facings that are folded over along the longitudinal edges of the batts or panels so that strips of insulation material can be cut away from one or both longitudinal edges of the batts or panels to fit the batts or panels between support members spaced apart less than the predetermined maximum spacing. This method of trimming the insulation batts at the job site to fit between the more closely spaced support members is time consuming, raises a significant risk or safety issue, relies heavily on the worker's skill to accurately trim the batt or panel, and can cause airborne dust and fibers.

U.S. Pat. No. 4,866,905; issued Sep. 19, 1989; to Bihy et al; discloses another approach to the problem. In the invention disclosed in this patent, a continuous strip of fibrous insulation with transverse marking lines is provided. The worker cuts the strip of fibrous insulation at the job site to a width somewhat greater than the spacing between the framing members, i.e. rafters, defining the space to be insulated. Of course this method of forming insulation batts or panels at the job site is also time consuming, relies heavily on the skill of the worker cutting the insulation strip to achieve a good result, and causes airborne dust and fibers.

A different approach to the problem is shown in U.S. Pat. No. 2,335,968; issued Dec. 7, 1943; to Sawtell. In the invention of this patent, the lateral edges of the insulation blanket are turned down to enable the insulation batt to be placed between framing members, i.e. rafters, spaced closer together than the width of the insulation batt. This approach does not require any cutting or trimming at the job site, but it can be used only where the spacing between the framing members is slightly less than the width of insulation blanket.

Insulation assemblies of standard widths and having batts of fibrous insulation encapsulated within plastic film envelopes, such as the insulation assembly disclosed in U.S. Pat. No. 5,277,955; issued Jan. 11, 1994; to Schelhorn et al; are currently being used to insulate walls, ceilings, floors and roofs of buildings. By encapsulating the fibrous insulation within the plastic film envelopes dust and loose fibers in the fibrous insulation are confined within the insulation assembly and can not cause irritation to the workers handling and installing the insulation assemblies. However, when using these insulation assemblies to insulate cavities having nonstandard widths less than the standard width, the insulation assemblies are trimmed at the job site. As with the insulation batts or panels discussed above, this method of insulating such cavities is time consuming and relies heavily on the skill of the worker to ensure a good fit. In addition, by cutting open the envelope encapsulating the fibrous insulation of the insulation assembly, dust and fibers normally confined within the envelope, as well as those caused by the cutting and trimming of the insulation batts, can become airborne thereby defeating one of the purposes of the insulation assembly.

Another method of insulating wall cavities is disclosed in U.S. Pat. No. 4,155,208; issued May 22, 1979; inventor Shanabarger. In the invention of this patent, a series of volumetrically expandable elongated bags, having no fibrous, foam or other insulation materials therein, are connected together by webs and dimensioned to fill the standard cavities between wall studs. During installation, the series of elongated bags and webs are unrolled along a wall with the bags aligned with the spaces or cavities between the wall studs and the webs aligned with the wall studs. The resilient deflated bags, which have transverse dimensions slightly larger than the transverse spacing between the studs, expand and draw ambient air into the bags to fill the bags with air and thereby fill the cavities between the studs with the air filled bags. The webs are stapled or otherwise secured to the studs. While the invention discloses an article for and a method of installing air filled bags between wall studs, the invention does not deal with the need to insulate nonstandard width, wall, ceiling, floor and roof cavities with fibrous, foam or similar insulation materials and, in particular, encapsulated fibrous insulation materials.

SUMMARY OF THE INVENTION

The present invention provides an insulation assembly for insulating both standard and nonstandard width wall, ceiling, floor and roof cavities with insulation materials, such as bonded, unbonded or binderless fibrous insulation blankets and other fibrous, foam or similar insulation materials, without exposing the workers to dust and/or fibers from the insulation material caused by cutting or trimming the insulation material and, preferably, through the encapsulation of the insulation material, from dust and/or fibers released from the insulation material during the manufacture, packaging, shipment, handling and installation of the insulation material.

As discussed above, trimming and/or cutting such insulation materials at the job site is a time consuming task which raises safety issues and the quality of the installation depends heavily on the skill and care taken by the worker performing the task. By eliminating the need for cutting and/or trimming such insulation materials at the job site and providing a means for forming insulation panels of such insulation materials, having not only standard widths but also various nonstandard widths less than or greater than the standard width for such cavities, at the job site by merely separating insulation modules from a series of such insulation modules forming the insulation assembly, the present invention not only eliminates airborne dust and fibers at the work site, but also assures a high quality installation of the insulation material in less time than previously required for insulating such nonstandard cavities with fibrous or foam insulation materials.

The insulation assembly of the present invention is formed of a series of elongated insulation modules that are separably joined together. The insulation panels formed from the insulation assemblies of the present invention are used for insulating wall, ceiling, floor and roof cavities having both standard widths and nonstandard widths less than or greater than the standard widths for such cavities. The modules of the insulation assemblies each include a fibrous, foam or similar insulation material, such as a polymeric fiber batt or blanket or a glass or other mineral fiber batt or blanket. Where a batt or blanket is used as the insulation material, the fibers of these batts or blankets may be bonded together with a binder (e.g. phenol/formaldehyde resole resins or water deliverable acrylic based binders), by heat bonding or other means (bonded fibrous batts or blankets) or may be binderless or essentially binderless (i.e. quantitatively having less than 1% binder by weight) and held together by fiber entanglement (unbonded fibrous batts or blankets). The modules of the insulation assemblies have widths less than the standard cavity width to be insulated in such wall, ceiling, floor and roof structures with at least two modules being required to insulate a standard width cavity.

Preferably, the insulation modules and the insulation material of the modules are compressible and resilient in the direction of their widths and the insulation material is encapsulated within a flexible envelope, such as a plastic film envelope. Generally, bonded batts or blankets exhibit a greater resilience than unbonded batts or blankets. Accordingly, when using fibrous batts or blankets as the insulating material in the modules, it may be preferred for certain applications to use bonded fibrous batts or blankets and in other applications to use unbonded fibrous batts or blankets.

To facilitate both the handling of multiple insulation modules as one piece and the separation of the insulation modules from each other to form an insulation panel of a selected width to fit the wall, ceiling, floor or roof cavity to be insulated, the modules are joined by flexible strips (preferably including weakened tear lines); by adhering the modules together; or by a similar means that permits the insulation modules to be readily separated from each other to form an insulation panel without exposing the encapsulated insulation material.

When using the insulation assembly of the present invention in the insulation of standard and nonstandard width wall, ceiling, floor and/or roofing cavities, the distance between opposed surfaces of two spaced-apart framing members is determined. The worker then detaches one or more preformed insulation modules from the series of insulation modules forming the insulation assembly to form an insulation panel having a width approximating the distance between the opposed surfaces of the framing members. The insulation panel thus formed is placed into the cavity defined in part by the framing members and is secured in place. Where the insulation modules are compressible and resilient in the direction of their widths, the insulation panel can be frequently held in place, solely or at least in part, by forming a friction fit between the side edges of the insulation panel and the opposed surfaces of the framing members. With this procedure, the insulation panel, which is formed to be slightly greater in width than the cavity being insulated, is compressed before inserting the insulation panel into the cavity and allowed to expand back into contact with the opposed surfaces of the framing members.

BRIEF DESCRIPTION OF THE DRAWINGS

FIG. 1 is a top view of an insulation assembly with elongated, preformed insulation modules of the present invention.

FIG. 2 is a partial perspective view of one embodiment of the present invention.

FIG. 3 is an enlarged view of the circled portion of FIG. 2.

FIG. 4 is a schematic view of an insulation panel of the present invention held in place in a nonstandard width cavity, at least in part, by a friction fit between the insulation panel and the opposed surfaces of adjacent framing members of a wall, ceiling, floor or roof structure.

FIG. 5 is an enlarged view of the circled portion of FIG. 4 showing a method of securing an insulation panel formed from the insulation assembly of FIG. 2 to a framing member by means of a fastener.

FIG. 6 is an enlarged view of the circled portion of FIG. 4 showing a second method of securing an insulation panel formed from the insulation assembly of FIG. 2 to a framing member by means of a fastener.

DESCRIPTION OF THE PREFERRED EMBODIMENTS

Figure 7:
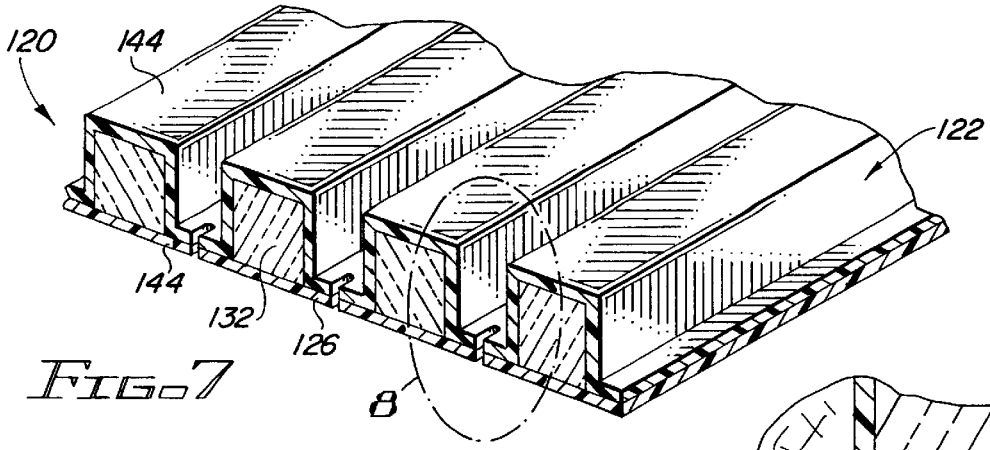
FIG. 7 is a partial perspective view of a second and most preferred embodiment of an the insulation assembly of the present invention.

FIG. 1 shows an insulation assembly 20 of the present invention which is formed of a series or plurality of elongated preformed, insulation modules 22 that are separably joined to each other. The length "L" of the insulation assembly 20 is typically selected to approximate the standard length or one half of the standard length of a wall cavity of the type of building being insulated. For example, in home or residential construction where the floor to ceiling dimension is typically eight feet, the length "L" of the insulation assembly, exclusive of any end tabs, is preferably forty seven or ninety four inches. The lengths of the ceiling, floor and roof cavities of such buildings vary with the design of the building and thus, the insulation assemblies used to form insulation panels for both the standard and nonstandard width wall cavities can also be used to insulate the ceiling, floor and roof structure cavities of standard and nonstandard widths. In addition to the standard lengths such as those set forth above, the length "L" of the insulation assembly can be any desired length such as those typically used in the industry for glass fiber roll insulation materials.

The widths "$W_M$" of each of the individual elongated insulation modules 22 is less than the standard width of the wall, ceiling, floor or roof cavities being insulated. The widths of the individual elongated insulation modules 22 are such that it would require two and preferably, more of the elongated insulation modules 22 to insulate or fill the cavity between two adjacent framing members which are spaced-apart a standard spacing for such framing members. For example, the nominal spacing between the opposed surfaces of adjacent wall studs or framing members in home or residential construction is fifteen or twenty three inches and the preferred widths for the elongated insulation modules of the present invention, used to insulate both standard and nonstandard width wall cavities for such constructions, are between about one and about eight inches and most preferably between about two and about four inches. The use of these relatively narrow width elongated insulation modules 22 along with the use of compressible, resilient insulation materials within the insulation modules 22, as in preferred embodiments of the present invention, permits the formation of insulation panels 24 that easily fit not only wall, ceiling, floor and roof cavities of standard widths but also cavities of various nonstandard widths and especially, cavities that are less than the standard widths for such cavities.

As shown in FIG. 1, the individual elongated insulation modules 22 of the insulation assembly in FIG. 1 are separably joined together by flexible connecting strips 26. Provided the connecting strips 26 are wide enough to accommodate weakened tear lines 28 or permit the easy severing of the connecting strip to separate adjacent insulation modules when forming an insulation panel 24, the widths "$W_S$" of the flexible connecting strips 26 are normally kept to a minimum to save material. However, where the tabs 30, formed by separating the connecting strips 26, are to be used as a means for mechanically fastening the insulation panels 24 to framing members, the widths of the strips must be wide enough to permit the tabs to extend along the framing members to surfaces where the mechanical fasteners can be passed through the tabs 30 as shown in FIG. 6. The embodiment of FIG. 10 also requires flexible connecting strips 26 of greater widths to enable the elongated insulation modules of this embodiment to be oriented relative to each other in two ways as will be further described in connection with the description of the embodiment of FIG. 10, below.

As shown, the flexible connecting strips 26 are coextensive in length with the individual elongated insulation modules 22 and are preferably formed from the same sheets used to encapsulate the insulation materials within the elongated insulation modules 22. However, the flexible connecting strips can also be in the form of bands (not shown) spaced-apart along the lengths of the elongated insulation modules and either formed from the same sheets that are used to encapsulate the insulation materials within the elongated insulation modules or from separate bands which are looped about or otherwise secured to the individual insulation modules 22.

While the length "L" of the insulation assembly 20, preferably approximates or equals the length or one half of the length of the wall cavities to be insulated. The widths of the insulation assemblies 20 can vary. When packaged and shipped in roll form, the insulation assemblies 20 can be quite wide e.g. about 40 feet. When packaged and shipped flat, the insulation assemblies 20 are preferably about standard cavity width, e.g. 15 or 23 inches wide, for ease of packaging, shipment and handling. Of course the wider the insulation assemblies 20, the fewer elongated insulation modules 22 are left over from the insulation assemblies 20 to be formed into insulation panels by combining them with elongated insulation modules 22 left over from other insulation assemblies. While combining left over modules 22 from different insulation assemblies eliminates scrap, combining elongated insulation modules 22 from two insulation assemblies 20 requires the handling of two pieces of insulation rather than one when insulating a cavity. Thus, it is preferred to insulate the standard and nonstandard cavities with insulation panels 24, which have all of the elongated insulation modules 22 joined together, rather than combining elongated insulation modules from two insulation assemblies 20.

Each elongated insulation module includes an insulation material 32 which, preferably, is encapsulated within a pliable envelope 34. The insulation material 32 may be a fibrous insulation, a foam insulation or a similar insulation material, but preferably, the insulation material is a fibrous insulation, such as conventional glass fiber building insulation, which is compressible and resilient. Where a fibrous batt or blanket is used as the insulation material, such as a polymeric fiber batt or blanket or a glass or other mineral fiber batt or blanket, the fibers of these batts or blankets may be bonded together with a binder (e.g. phenol/formaldehyde resole resins or water deliverable acrylic based binders), by heat bonding or other means (bonded fibrous batts or blankets) or may be binderless or essentially binderless (i.e. quantitatively less than 1% by weight) and held together by fiber entanglement (unbonded fibrous batts or blankets). Generally, bonded fibrous batts or blankets exhibit a greater resilience than unbonded fibrous batts or blankets. Accordingly, when using fibrous batts or blankets as the insulating material in the modules, it may be preferred for certain applications to use bonded fibrous batts or blankets and in other applications to use unbonded fibrous batts or blanket.

Typically, the pliable envelope 34 is made of a thin plastic film, kraft paper, nonwoven fabric, laminates of such materials or similar sheet materials. The module can also be faced with one sheet material on one major surface and another sheet material on the remaining surfaces, e.g. kraft paper on one major surface and a plastic film on the sides and the other major surface. A typical thin plastic film used for forming the envelope 34 is a permeable or impermeable, pliable film, such as but not limited to a polyethylene film about 0.1 to about 1.5 mils thick, which may be metalized. Such films can be perforated to permit vapor transmission while still encapsulating dust and/or lose fibers within the envelope 34 or solid to impede vapor transmission. By encapsulating the insulation materials 32 of the elongated insulation modules within envelopes 34, dust and/or loose fibers or particles of the insulation materials formed during the manufacture, encapsulating, packaging, shipping, handling and installation of the elongated insulation modules are contained within the envelope and do not become airborne or otherwise become a possible irritant to the workers handling and installing the insulation modules.

By using an insulation material in the elongated insulation modules which is both compressible and resilient, at least in the direction of the width of the elongated insulation module, the insulation panels 24 formed from the elongated insulation modules can be held in place between two framing members by a friction fit between the insulation panels and the framing members. Preferably, the insulation of the elongated insulation modules 22 is fully encapsulated within the envelopes 34. Where an impermeable film is used to form the envelopes, several holes or apertures can be formed in the envelopes (e.g. holes about one quarter to one half inch in diameter in the ends of the modules 22) to permit ambient air to be both expelled from the elongated insulation modules 22 during compression of the elongated insulation modules and introduced into the elongated insulation modules during the expansion of previously compressed insulation modules caused by the expansion of the resilient insulation materials 32 within the envelopes 34 of the elongated insulation modules and/or the resiliency of the film forming the envelopes 34. While it is preferred to completely encapsulate the insulation materials 32 within the envelopes 34, the ends of the envelopes 34, at the ends of the elongated insulation modules, can be left open or partially open. While the insulation materials are not thereby fully encapsulated, the insulation materials are still encapsulated to a great extent and the insulation panels 24 can still be handled without touching the insulation materials.

FIGS. 2 and 3 show one embodiment of the present invention. In this embodiment the elongated insulation modules 22 forming the insulation panel 24 are all equal in width. Typically, the widths of the elongated insulation modules 22 are about two, three or four inches. The thickness "$T_M$" of the elongated insulation modules 22 is a selected thickness relating to the amount of thermal resistance or sound control desired or can be selected to approximate the depth of the wall, ceiling, floor or roofing cavity being insulated to maximize the thermal resistance or sound control of the insulation panel 24 formed from the elongated insulation modules. For example, in a wall cavity defined in part by nominally 2×4 or 2×6 inch studs or framing members, the insulation modules 22 will have thicknesses of about three and one-quarter or three and one-half inches and five and one half inches respectively.

As shown, the insulation material 32 of each elongated insulation module is encapsulated within the pliable envelope 34 and the elongated insulation modules are separably joined by the flexible connecting strips 26 which are coextensive with the length of the elongated insulation modules and formed from the same sheets or films as the envelopes 34. In the embodiment of FIGS. 2 and 3, the flexible connecting strips 26 extend between the sidewalls 42 of adjacent elongated insulation modules intermediate the junctures of the sidewalls 42 and the upper and lower surfaces 44 of the insulation modules which normally form the major surfaces of the insulation panels 24 formed from the elongated insulation modules (as shown about midway between the surfaces 44 forming the major surfaces of the insulation panels 24). As best shown in FIG. 3, the flexible connecting strips 26, formed from the facing sheets or film of the envelopes, are joined together by chemical or heat welds 46, adhesives or are otherwise adhered or joined together along the lengths of the strips. Preferably, the flexible connecting strips 26 are provided with the weakened tear lines 28 which, as shown, are perforated lines that are coextensive with the flexible connecting strips. The weakened tear lines, which may be score lines, perforated lines or other conventional means of forming a weaken line, facilitate the easy separation of adjacent elongated insulation modules without damaging the envelopes encapsulating the insulation materials 32 of the elongated insulation modules.

FIG. 4 shows a compressible and resilient insulation panel 24, formed from the elongated insulation modules 22 of the insulation assembly 20, installed between opposed surfaces of the framing members 36 in a wall, ceiling, floor or roof cavity, having a nonstandard width less than a standard width between such frame members. As shown, the spacing between the opposed surfaces of the framing members is about eight inches. An insulation panel 24, normally nine inches wide in its uncompressed state and formed from three connected elongated insulation modules 22 which are each three inches in width when the resilient insulation material in the insulation modules is uncompressed, fills the nonstandard cavity and is held in place in the nonstandard cavity, solely or at least in part, by a friction fit between the sides of the insulation panel 24 and the opposed surfaces of the framing members 36. The insulation panel 24 is formed by detaching three connected elongated insulation modules 22 from an insulation assembly 20 and is installed by compressing the insulation panel in the direction of its width, inserting the insulation panel into the cavity, and allowing the insulation panel to expand into contact with the opposed surfaces of the framing members 36.

FIG. 5 shows the insulation panel 24 of FIG. 4 with a mechanical fastener 38, such as a staple, passing through the envelope 34 and into the framing member 36. When the insulation panel 24 is compressed in the direction of its width, the envelopes 34 loosen about the insulation material within the envelopes and a portion of this loose film or sheet material can be formed into a tab 40, as shown in FIG. 5, to enable the insulation panel 24 to be secured to the framing members 36 with mechanical fasteners.

FIG. 6 shows the insulation panel 24 of FIG. 4 with a mechanical fastener 38, such as a staple, passing through a tab 30 formed by the separation of the flexible connecting strip 26 between adjacent elongated insulation modules 22 of an insulation assembly 20. In this embodiment of the invention, the width of the flexible connecting strips 26 must be such that the tabs 30 formed by separating the flexible connecting strips along the weakened tear lines are wide enough to reach a location on the side or end of the framing members 36 where mechanical fasteners 38 can be passed through the tabs 30 and into the framing members 36.

Figure 8:
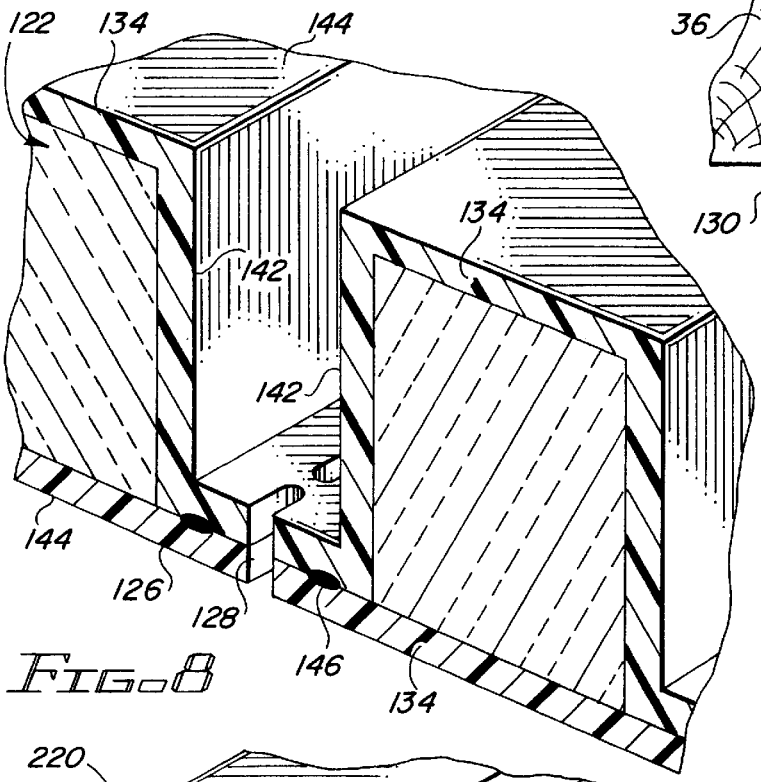
FIG. 8 is an enlarged view of the circled portion of FIG. 7.
Figure 9:
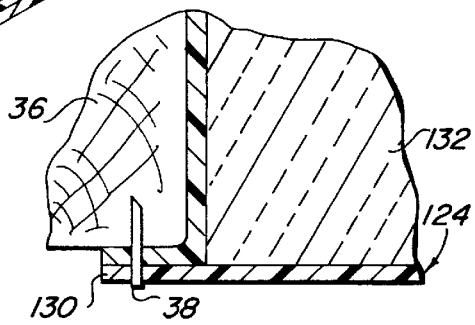
FIG. 9 is an enlarged view of the circled portion of FIG. 4 showing a method of securing an insulation panel formed from the insulation assembly of FIG. 7 to a framing member by means of a fastener.

FIGS. 7 and 8 show preferred embodiment 120 of the present invention. The insulation assembly 120 includes a series of elongated insulation modules 122, with encapsulated insulation 132, which are joined together by flexible connecting strips 126, preferably, having weakened tear lines 128 as shown in FIG. 8. Except for the location of the flexible connecting strips 126, the embodiment of FIGS. 7 and 8 is like the embodiment of FIGS. 2 and 3. However, the flexible connecting strips 126 extend between longitudinal edges of the adjacent elongated insulation modules 122 defined by the junctures of the sidewalls 142 and the surfaces 144 forming the major surfaces of the insulation panels 124 formed from the insulation modules 122. While, as mentioned above, adhesives or other conventional means can be used to join the envelope sheets together to form the flexible connecting strips 126, the flexible connecting strips 126 are shown with chemical or heat welds 146 adhering the two sheets of the envelopes 134 together to form the connecting strips. While the tear lines 128 can be formed by score lines or other methods of weakening the connecting strips 126, the connecting strip shown in FIG. 8 is provided with a perforated tear line 128. FIG. 9 shows a mechanical fastener 38, such as a staple, securing a tab 130 of the insulation panel 124 to a framing member 36.

Figure 10:
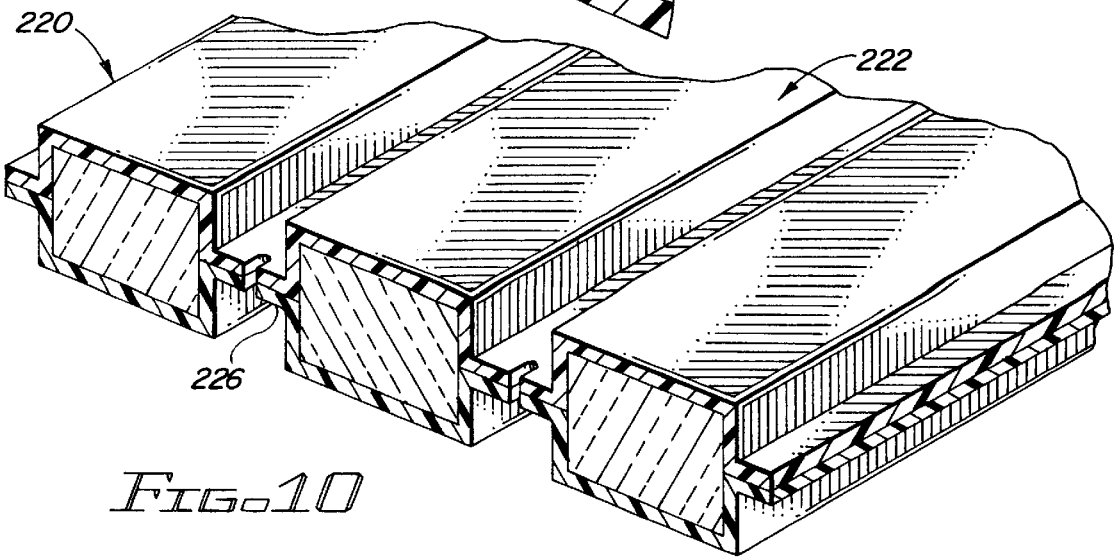
FIG. 10 is a partial perspective view of a third embodiment of the insulation assembly of the present invention.
Figure 11:
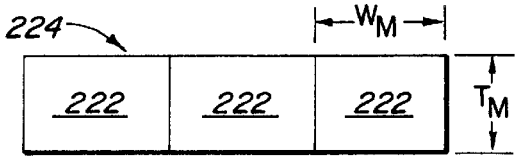
FIG. 11 is a schematic view of an insulation panel formed from the insulation assembly of FIG. 10 with the individual elongated insulation modules of the insulation panel oriented to provide an insulation panel of a first thickness.
Figure 12:
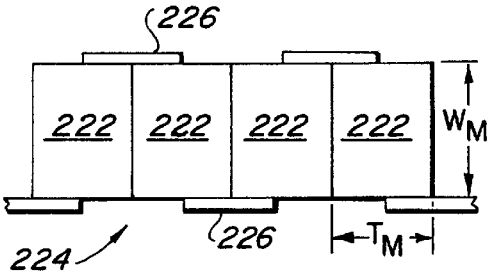
FIG. 12 is a schematic view of an insulation panel formed from the insulation assembly of FIG. 10 with the individual elongated insulation modules of the insulation panel oriented to provide an insulation panel having a thickness greater than the insulation panel of FIG. 11.

FIG. 10 shows another embodiment 220 of the present invention wherein the widths "$W_M$" and the thicknesses "$T_M$" of the elongated insulation modules 222 differ and the flexible connecting strips 226 are wide enough to permit adjacent elongated insulation modules 222 to be oriented in two positions relative to each other. In a first position, shown schematically in FIG. 11, the sides of the elongated insulation modules 222 abut each other and the upper and lower surfaces of the elongated insulation modules form the major surfaces of the insulation panel 224. Thus, by way of example, where the elongated insulation modules 222 are three and one-quarter or five and one-half inches wide and two inches thick, the insulation panel 224, schematically shown in FIG. 11, is nine and three-quarter inches or sixteen and one-half inches wide by two inches thick. In a second position, shown schematically in FIG. 12, the upper and lower surfaces of the elongated insulation modules 222 abut each other and the sides of the elongated insulation modules form the major surfaces of the insulation panel 224. Thus, by way of example, where the elongated insulation modules 222 are three and one-quarter or five and one-half inches wide and two inches thick, the insulation panel 224, schematically shown in FIG. 12 is eight inches wide and three and one-quarter or five and one-half inches thick.

Other than the differences described above and the fact that insulation materials such as fiber glass do not typically have the same compressibility, resilience and thermal resistance in both directions, the insulation assembly 220 of FIG. 10 and the insulation panels 224 formed from the elongated insulation modules 222 of the insulation assembly 220 are the same as the insulation assembly and insulation panel of FIGS. 2, 3, 5 and 6.

Figure 13:
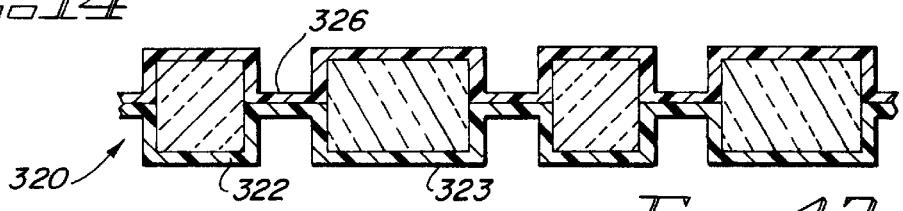
FIG. 13 is a schematic view of an insulation panel of the present invention wherein the individual elongated insulation modules vary in width.

FIG. 13 is a schematic of an insulation assembly 320 of the present invention wherein the elongated insulation modules 322 and 323 have different widths. The flexible connecting strips 326 are shown extending between the sidewalls of the adjacent elongated insulation modules 322 and 323 as in the embodiment of FIGS. 2 and 3. However, the flexible connecting strips 326 can also extend between the adjacent elongated insulation modules 322 and 323 as shown in FIGS. 7 and 8. Other than having elongated insulation modules of different widths, the insulation modules 322 and 323 and the insulation assemblies 320 and the insulation panels formed therefrom are the same as the elongated insulation modules, the insulation assemblies, and the insulation panels of FIGS. 2 and 3 and FIGS. 7 and 8 respectively.

Figure 14:
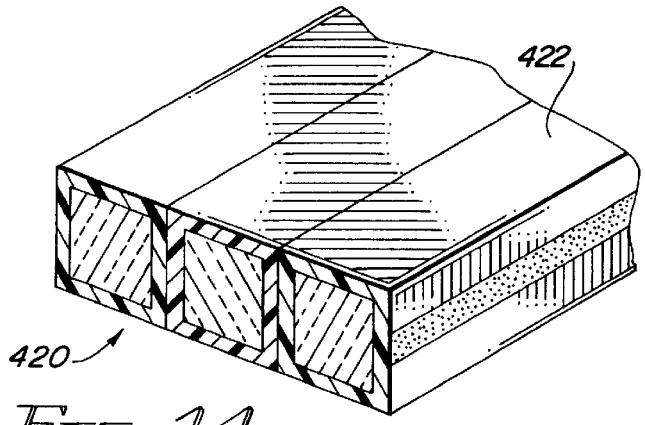
FIG. 14 is a partial perspective view of an insulation assembly of the present invention wherein the individual elongated insulation modules are separably adhered together.

FIG. 14 shows an embodiment 420 of the present invention wherein the elongated insulation modules 422 of the insulation assembly 420 are separably adhered together, with an adhesive, a pressure sensitive adhesive, a heat weld or similar means, rather than being connected with a flexible connecting strip 26. As with the other embodiments, the insulation materials of the elongated insulation modules are preferably encapsulated within pliable, permeable or impermeable envelopes and the insulation material is preferably a compressible, resilient insulation material, such as glass fiber insulation batts. The means used to adhere the elongated insulation modules together should enable the elongated insulation modules to be separated or detached from each other without tearing the envelopes. The insulation panels formed from these elongated insulation modules can be typically held in place by a friction fit and/or as shown in FIG. 5.

Figure 15:
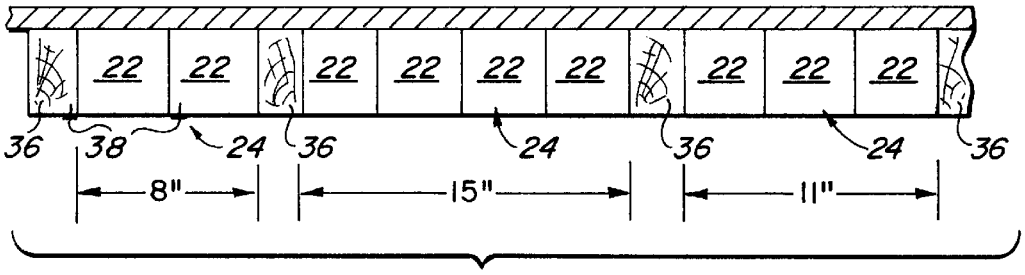
FIG. 15 is a section through a wall, floor, ceiling or roof of a building structure schematically showing both a standard cavity and nonstandard cavities insulated with insulation panels of the present invention.

FIG. 15 shows a wall, ceiling, floor or roof structure with a standard fifteen inch wide cavity, an eight inch wide cavity and an eleven inch wide cavity. The standard width cavity is insulated with an insulation panel 24 comprising four, four inch wide insulation modules that is held in place by a friction fit between the insulation panel 24 and the framing members 36. The eight inch wide cavity is insulated with an insulation panel 24 comprising two, four inch wide insulation modules that is held in place with staples or other mechanical fasteners driven through the envelope of the insulation panel and into the framing members 36. The eleven inch wide cavity is insulated with an insulation panel 24 comprising three, four inch wide insulation modules that is held in place by a friction fit between the insulation panel 24 and the framing members 36.

Figure 16:
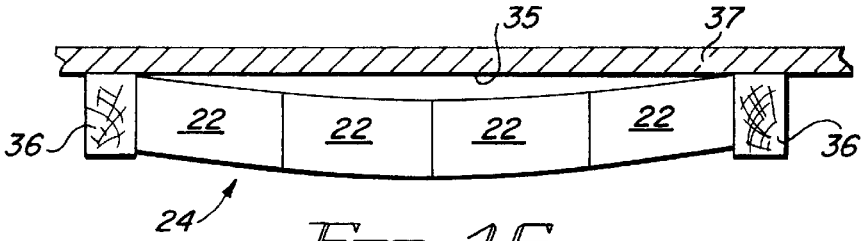
FIG. 16 is a section through a wall, floor, ceiling or roof cavity of a building structure schematically showing an insulation panel of the present invention bulging out from the cavity.

Should an insulation panel 24 tend to bulge out as shown in FIG. 16, an adhesive material applied to the major inner surface 35 of the structural panel 37 forming the back of the cavity (e.g. a plywood, sheetrock or other panel), prior to placing the insulation panel 24 into the cavity, will keep the insulation panel from bulging. In addition, any tendency of an insulation panel 24 to bulge out can be greatly diminished or eliminated by properly selecting the width of the insulation panel 24 to assure a good friction fit with the framing members 36. While the adhesive may be applied to the inner surface 35 of the structural panel 37 in many ways, a preferred method of applying the adhesive to the surface 35 is by means of an aerosol spray.

In certain overhead applications, such as ceiling or roof applications, lower sheeting or other structural panels (not shown) applied to the frame members 36 may also be used to hold or help hold the insulation panels 24 in place. In other overhead applications, such as crawl spaces, wires, rods or twine may be used to hold or help hold the insulation in place.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A building structure having elongated building wall, ceiling, floor and/or roof cavities, defined in part by spaced-apart parallel framing members, having nominal standard cavity widths of at least fifteen inches and various nonstandard cavity widths less than the standard cavity width for said cavities, comprising:

spaced-apart parallel framing members; two adjacent framing members of said spaced-apart framing members being spaced-apart a distance equal to or less than a standard spacing for adjacent framing members;

an insulation panel comprising at least two elongated, preformed insulation modules which each comprise an insulation material encapsulated within an envelope means; each of said elongated, preformed insulation modules having a width between about one inch and about eight inches; said elongated, preformed insulation modules being joined together by a means for separably joining said insulation modules which permits said insulation modules to be readily separated without exposing the encapsulated insulation material within the envelope means; and said insulation panel being held in place between said two adjacent framing members.

2. The building structure of claim 1, wherein: said elongated, preformed insulation modules are separably joined together.

3. The building structure of claim 1, wherein: said elongated, preformed insulation modules are separably joined together by flexible strips which extend between and are secured to adjacent modules of said elongated, preformed insulation modules.

4. The building structure of claim 2, wherein: adjacent modules of said elongated, preformed insulation modules are separably adhered together.

5. The building structure of claim 1, wherein: said elongated, preformed insulation modules are compressible and resilient in a direction parallel to said widths of said elongated, preformed insulation modules and said insulation panel is held in place between said two adjacent framing members, at least in part, by a friction fit between said insulation panel and opposed sidewalls of said two adjacent framing members.

6. The building structure of claim 5, wherein: said insulation material of each of said elongated, preformed insulation modules is compressible and resilient.

7. The building structure of claim 5, wherein: said insulation material is encapsulated within a flexible envelope.

8. The building structure of claim 7, wherein: said envelopes of said elongated, preformed insulation modules are separably joined to said envelopes of adjacent modules of said elongated, preformed insulation modules.

9. The building structure of claim 8, wherein: said envelopes of said adjacent modules of said elongated, preformed insulation modules are separably joined by flexible strips which extend between and are secured to said adjacent modules of said elongated, preformed insulation modules.

10. The building structure of claim 9, wherein: envelopes and said flexible strips are integral and comprise a plastic film.

11. The building structure of claim 10, wherein: said flexible strips have weakened elongated severance lines which extend parallel to longitudinal centerlines of said elongated, preformed insulation modules.

12. The building structure of claim 7, wherein: said insulation material is a fibrous insulation.

13. The building structure of claim 12, wherein: said fibrous insulation is a bonded fibrous blanket.

14. The building structure of claim 12, wherein: said fibrous insulation is an unbonded fibrous blanket.

15. The building structure of claim 7, wherein: said insulation material is a foam insulation material.

16. The building structure of claim 1, wherein: said insulation panel comprises at least three elongated, preformed insulation modules which are joined together.

17. A method of insulating elongated wall, ceiling, floor and/or roof cavities, defined in part by spaced-apart parallel framing members, having nominal standard cavity widths of at least fifteen inches and various nonstandard cavity widths less than the standard cavity width for said cavities, comprising:

providing a series of elongated, preformed insulation modules for insulating elongated building wall, ceiling, floor and/or roof cavities; each of said elongated, preformed insulation modules comprising an insulation material encapsulated within an envelope means; each of said elongated, preformed insulation modules having a width between about one inch and about eight inches; and said elongated, preformed insulation modules being separably joined to adjacent elongated, preformed insulation modules in said series of elongated, preformed insulation modules;

determining the distance between opposed surfaces of two adjacent spaced-apart, parallel framing members of a cavity of said building structure;

detaching at least one elongated, preformed insulation module from said series of insulation modules without exposing said encapsulated insulation material within said envelope means to form an insulation panel having a width approximating the distance between said opposed surfaces of said two adjacent spaced-apart, parallel framing members;

inserting said insulation panel into said cavity between said opposed surfaces of said two adjacent spaced-apart parallel framing members; and securing said insulation panel in place between said opposed surfaces of said two adjacent spaced-apart, parallel framing members.

18. The method according to claim 17, wherein: each of said elongated, preformed insulation modules is compressible and resilient in a direction parallel to said width of said elongated, preformed insulation module and said insulation panel is secured in place between said opposed surfaces of said two adjacent spaced-apart framing members, at least in part, by compressing said insulation panel in the direction of the widths of said elongated, preformed insulation modules, inserting said insulation panel between said opposed surfaces of said two adjacent spaced-apart, parallel framing members, and allowing said insulation panel to expand against said opposed surfaces of said two adjacent spaced-apart, parallel framing members.

19. The method according to claim 18, wherein: said insulation material of each of said elongated, preformed insulation modules is compressible and resilient.

20. The method according to claim 19, wherein: said insulation material is encapsulated within a flexible envelope.

21. The method according to claim 20, wherein: said envelopes of said elongated, preformed insulation modules are separably joined to said envelopes of adjacent modules of said elongated, preformed insulation modules and said envelope of said elongated, preformed insulation module which is separated from said series of insulation modules to form said insulation panel is separated without exposing said insulation material within said envelopes.

22. The method according to claim 21, wherein: said insulation material is a fibrous insulation.

23. The method according to claim 22, wherein: said fibrous insulation is a bonded fibrous blanket.

24. The method according to claim 22, wherein: said fibrous insulation is an unbonded fibrous blanket.

25. The method according to claim 21, wherein: said insulation material is a foam insulation.

26. The method according to claim 21, wherein; said envelopes comprise a plastic film and said envelopes of adjacent elongated, preformed insulation modules in said series of insulation modules are separably joined by flexible strips extending between and integral with said envelopes which strips have weakened elongated severance lines that extend parallel to longitudinal centerlines of said elongated, preformed insulation modules; and said envelope of said elongated, preformed insulation module which is separated from said series of insulation modules to form said insulation panel is separated along one of said severance lines an adjoining elongated, preformed insulation module remaining with said series of elongated, preformed insulation modules.

27. The method according to claim 17, wherein: at least two elongated, preformed insulation modules are detached from said series of insulation modules to form said insulation panel.

28. The method according to claim 17, wherein: at least three elongated, preformed insulation modules are detached from said series of insulation modules to form said insulation panel.

29. The method according to claim 17, including: applying an adhesive material to a back surface of said cavity prior to inserting said insulation panel into said cavity to at least help secure said insulation panel in place.

* * * * *